United States Patent [19]

Wood

[11] Patent Number: 4,658,459

[45] Date of Patent: Apr. 21, 1987

[54] FLOOR POLISHING MACHINE

[75] Inventor: David W. Wood, Maple Plain, Minn.

[73] Assignee: Advance Machine Company, Spring Park, Minn.

[21] Appl. No.: 823,006

[22] Filed: Jan. 27, 1986

[51] Int. Cl.[4] ..... A47L 11/162

[52] U.S. Cl. ..... 15/49 R; 15/98; 51/177

[58] Field of Search ..... 15/49 R, 49 C, 50 R, 15/50 C, 98, 385; 51/177

[56] References Cited

U.S. PATENT DOCUMENTS

| | | | |
|---|---|---|---|
| 1,650,690 | 11/1927 | Cavicchi | 15/49 R |
| 1,875,138 | 8/1932 | Pond et al. | 15/49 R |
| 2,142,697 | 1/1939 | Myers | 15/49 R |
| 3,100,903 | 8/1963 | Doyle, Sr. | 15/49 R |
| 3,154,802 | 11/1964 | Hanschitz et al. | 15/49 R |
| 3,303,524 | 2/1967 | Schneider | 15/49 R |
| 4,115,890 | 9/1978 | Burgoon | 15/49 R |
| 4,358,868 | 11/1982 | Cook, Jr. | 15/49 R |

*Primary Examiner*—Edward L. Roberts

*Attorney, Agent, or Firm*—Peterson, Wicks, Nemer & Kamrath

[57] ABSTRACT

A floor polishing machine according to the preferred form of the teachings of the present invention includes a body portion having a platform, and a handle pivotally mounted to the platform. First and second sets of wheels are provided adjacent the rear of the platform and on opposite sides of the handle pivot. For coupling the handle and the platform together, torsion springs are provided having first ends anchored to the platform and having second ends connected to the handle. The torsion springs urge the platform to pivot about the first set of wheels downwardly in the rear and upwardly in the front. The level of the second set of wheels is slightly above the level of the first set of wheels for limiting the amount of upward movement of the front of the platform by the torsion springs when the polishing member is not being rotated by the motor allowing a partial vacuum to be formed under the polishing member when it is rotated by the motor to place a downward suction on the polishing member and counteracting with the torsion springs to place an even force on the floor surface by the polishing member regardless of the pivotal position of the handle with respect to the platform and regardless of the unevenness of the floor surface.

20 Claims, 4 Drawing Figures

FLOOR POLISHING MACHINE

BACKGROUND

The present invention relates generally to floor polishing machines, and specifically to floor polishing machines which automatically maintain even pressure on the polishing member thereof.

In the operation of floor polishing machines and the like, it is desirable to control the amount of weight the floor polishing machine places upon the pad or other polishing member of the floor polishing machine. This weight control is important in controlling the polishing pressure the pad or polishing member places on the floor surface and in controlling the amperage draw of the motor of the floor polishing machine. Prior to the present invention, this weight control was generally accomplished by having a fixed handle on the floor polishing machine, where the operator controlled the pad pressure by lifting or pushing on the handle. The problem with this type of operator involvement was the pad pressure was variable because different operators place different pressures on the polishing member of the floor polishing machine and because of operator fatigue. Other techniques have been developed prior to the present invention; however, these other techniques also suffer from variable pad pressure and like disadvantages.

Thus, a need has arisen for a floor polishing machine which maintains even pad pressure automatically and not dependant on operator involvement.

SUMMARY

The present invention solves this and other needs and problems in floor polishing machines by providing, in the most preferred form, a coupling member between the machine platform and a handle pivotally mounted thereto. The coupling member pivots the platform about the axis of a first set of wheels to bias the front of the platform upwardly. A member for limiting the amount of upward movement of the front of the platform by the coupling member when the polishing member is not being rotated is further provided for allowing a partial vacuum to be formed under the polishing member when it is rotated to place a downward suction on the polishing member and to counteract with the coupling member to place an even force on the floor surface by the polishing member of the machine regardless of the pivotal position of the handle with respect to the platform and of the unevenness of the floor surface.

Thus, it is an object of the present invention to provide a novel machine for polishing floor surfaces.

It is further an object of the present invention to provide such a novel floor polishing machine which places even polishing force on the floor surface by the polishing member regardless of the pivotal position of the handle with respect to the platform.

It is further an object of the present invention to provide such a novel floor polishing machine which places even polishing force on the floor surface by the polishing member regardless of the unevenness of the floor surface.

It is further an object of the present invention to provide such a novel floor polishing machine which automatically maintains even polishing pressure.

It is further an object of the present invention to provide such a novel floor polishing machine which maintains even floor polishing pressure without being dependent on operator involvement.

It is further an object of the present invention to provide such a novel floor polishing machine having polishing pressure which is not variable due to operation by different operators.

It is further an object of the present invention to provide such a novel floor polishing machine having polishing pressure which is not variable due to operator fatigue.

It is further an object of the present invention to provide such a novel floor polishing machine which urges the forward head upward while utilizing suction effect to control relatively even polishing pressure.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
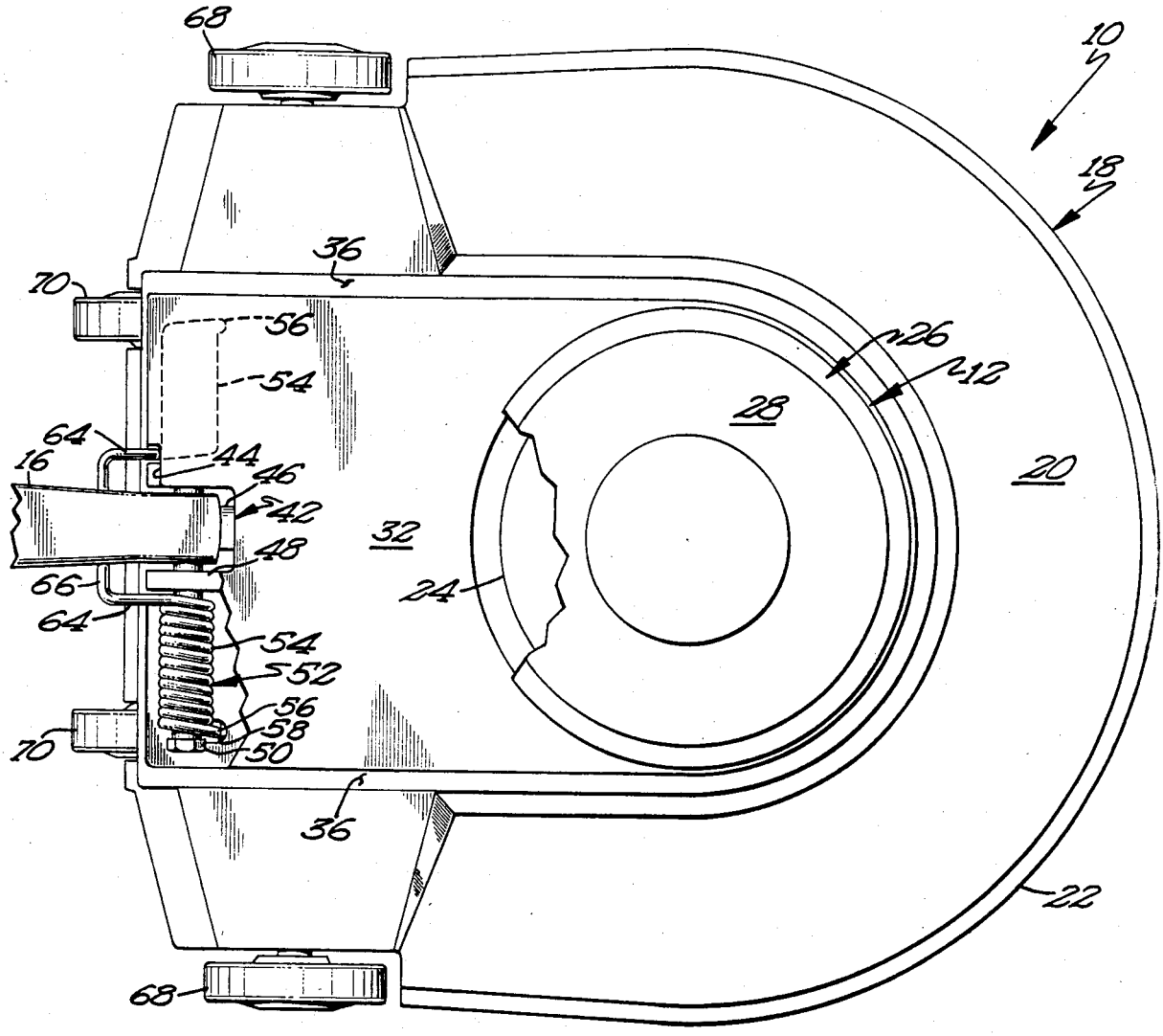
FIG. 1 shows a partial, top view of a preferred form of a floor polishing machine constructed according to the teachings of the present invention, with portions being broken away to expose internal components.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A floor machine is shown in the drawings in its most preferred form as a floor polishing machine according to the teachings of the present invention and is generally designated 10. Floor polishing machine 10 generally includes a body portion 12 adapted to be moved along a floor, a polishing member 14 such as a holder for a polishing pad, brush, or the like, and a handle 16 for guiding and controlling the body portion 12, with handle 16 being pivotally mounted to body portion 12 between operating positions and a transport position.

Body portion 12 according to the teachings of the present invention includes a first, substantially inverted cup-shaped, skirt housing 18 having a relatively flat platform 20 and a downwardly extending perimeter skirt 22. A motor 24 is mounted on the top of the platform 20 by any suitable means. Polishing member 14 is operatively connected to motor 24 for rotation thereby and within housing 18.

In its most preferred form, body portion 12 according to the teachings of the present invention further includes a second, substantially inverted cup-shaped housing or motor shroud 26 received on housing 18 for encasing motor 24. In the most preferred form of the present invention, housing 26 generally includes a cylindrical shaped portion 28 and a generally box shaped portion 30. Portion 30 includes a generally closed top 32, a generally open bottom 34 for receipt and mating on platform 20, first and second generally closed sides 36, a first, generally closed end 38, and a second generally open end 40 which is formed by top 32 and sides 36 terminating and secured to portion 28. Motor 24 is received within portion 28 of housing 26. In its most preferred form, portion 30 includes a T-shaped opening 42, with the head 44 thereof formed in and extending in end 38 between sides 36 and with the leg 46 thereof formed in and extending in top 32 from end 38 and parallel to sides 36.

For pivotally mounting handle 16 to body portion 12, ears 48 are provided extending from platform 20 of housing 18 in the preferred form of the present invention and extending on opposite sides and parallel to leg 46 of opening 42 of housing 26. Handle 16 extends through opening 42 of housing 26 and is located intermediate ears 48. For pivotally mounting handle 16 to body portion 12, an elongated pivot pin 50 is provided extending between ears 48 and through handle 16 spaced from its end. It should then be appreciated that handle 16 is pivotally moveable within leg 46 of opening 42 of portion 30 of housing 26.

Member 52 for urging the front of body portion 12 upward towards handle 16 is further provided according to the teachings of the present invention and is shown in its preferred form as including first and second torsion springs 54. Torsion springs 54 are located concentrically on pivot pin 50 on opposite sides of ears 48 than handle 16. First ends 56 of springs 54 are anchored to platform 20 of body portion 12 of floor polishing machine 10. In its most preferred form, ends 56 extend through an aperture 58 formed in platform 20 and abut with a bolt 60 threadably received in a boss 62 integrally formed on the bottom surface of platform 20 of housing 18. Thus, by turning bolt 60 into or out of boss 62, adjustment of the position of end 56 and the torsional loading of springs 54 may be varied as desired. Second ends 64 of springs 54 extend through head 44 of opening 42 formed in housing 26 and their free ends are interconnected together such as by connection member 66. In the most preferred form of the present invention, ends 64 and connection member 66 have a generally U-shape. Connection member 66 abuts with handle 16 at a position above pivot pin 50 such that handle 16 is biased in an upright position towards the front of body portion 12 of floor polishing machine 10.

Floor polishing machine 10 further includes according to the teachings of the present invention a first set of wheels 68 having a rotation axis located intermediate motor 24 and pivot pin 50, and extending at a level generally equal to but slightly lower than the level of polishing member 14. In its most preferred form, wheels 68 are rotatably secured to skirt 22 of housing 18 of body portion 12.

According to the teachings of the present invention, floor polishing machine 10 further includes a second set of wheels 70 having a rotation axis located on the opposite side of wheels 68 than motor 24 and particularly on the opposite side of pivot pin 50 than wheels 68 and motor 24 and extending at a level slightly above the level of polishing member 14. In its most preferred form, wheels 70 extend at a level in the range of one-eighth to one-fourth inch above the level of wheels 68. In the preferred construction of floor polishing machine 10, wheels 70 are rotatably secured to skirt 22 of housing 18 of body portion 12 and in particular the rotation axis of wheels 70 is generally parallel and adjacent to skirt 22 of housing 18 of body portion 12 such that wheels 70 extend beyond and rearward of skirt 22 of housing 18 of body portion 12.

In its most preferred form of floor polishing machine 10 according to the teachings of the present invention, wheels 68 extend below polishing member 14 a sufficient distance such that polishing member 14 does not engage the floor surface when it is not rotating and when the front of platform 20 is being urged by member 52 with handle 16 in an operating position. Furthermore, wheels 68 extend below polishing member 14 in floor polishing machine 10 according to the teachings of the present invention a distance such that approximately the front two-thirds of polishing member 14, i.e. from the 8 o'clock to 4 o'clock position of polishing member 14, engages the floor surface when it is rotated by motor 24.

In its most preferred form, the end of handle 16 extending beyond pivot pin 50 of floor polishing machine 10 according to the teachings of the present invention extends through and is moveable within an opening formed in platform 20 of housing 18 between ears 48. In its most preferred form, floor polishing machine 10 includes a detent-like member or handle catch 76 located beneath the platform opening and attached to skirt 22 of housing 18. In its most preferred form, a plunger or plug 78 is reciprocally received in the free end of handle 16 and includes a tooth member 80 formed therein complementary to and for mating with member 76. Plug 78 may be reciprocated in handle 16 by any suitable means such as a cable 82 extending from plug 78 within handle 16 to a suitable control lever. It can then be appreciated that when member 80 of handle 16 is not received in member 76 of body portion 12, handle 16 is free to pivot with the free end of handle 16 traveling in the platform opening in the preferred form of the present invention.

It can then be appreciated that when member 80 of plug 78 of handle 16 is received in member 76 of body portion 12, handle 16 is prevented from pivoting with respect to body portion 12 and is held in an upright, transport position generally perpendicular to polishing member 14. Thus, when handle 16 is latched in its upright position, floor polishing machine 10 may be tilted rearwardly until wheels 70 engage the floor surface and such that polishing member 14 is spaced from the floor. This permits floor polishing machine 10 according to the teachings of the present invention to be transported when not in use and also allows access to floor polishing member 14.

Figure 2:
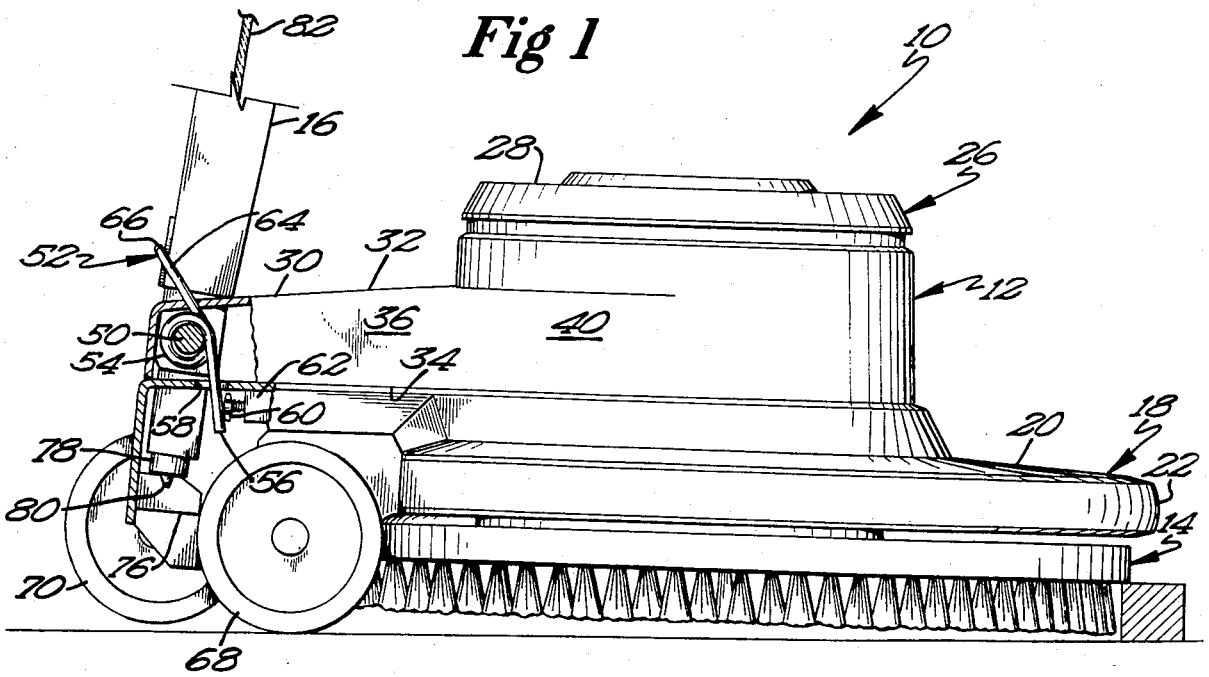
FIG. 2 shows a side view of the floor polishing machine of FIG. 1 in a stored condition and with the handle locked in a transport condition, with portions being broken away to expose internal components.

Now that the preferred construction of floor polishing machine 10 according to the teachings of the present invention has been set forth, the operation and subtle features of the present invention can be set forth and appreciated. Due to the relatively large mass of motor 24, when handle 16 is not supported by an operator, such as when it is in storage, floor polishing machine 10 will rest on wheels 68 and the front of polishing member 14. To prevent deformation of polishing member 14 during long term storage, it is desirable to place a block under a portion of the front of floor polishing machine 10 as shown in FIG. 2 such that the cleaning portions of polishing member 14 does not have weight thereon for long periods of time.

Figure 3:
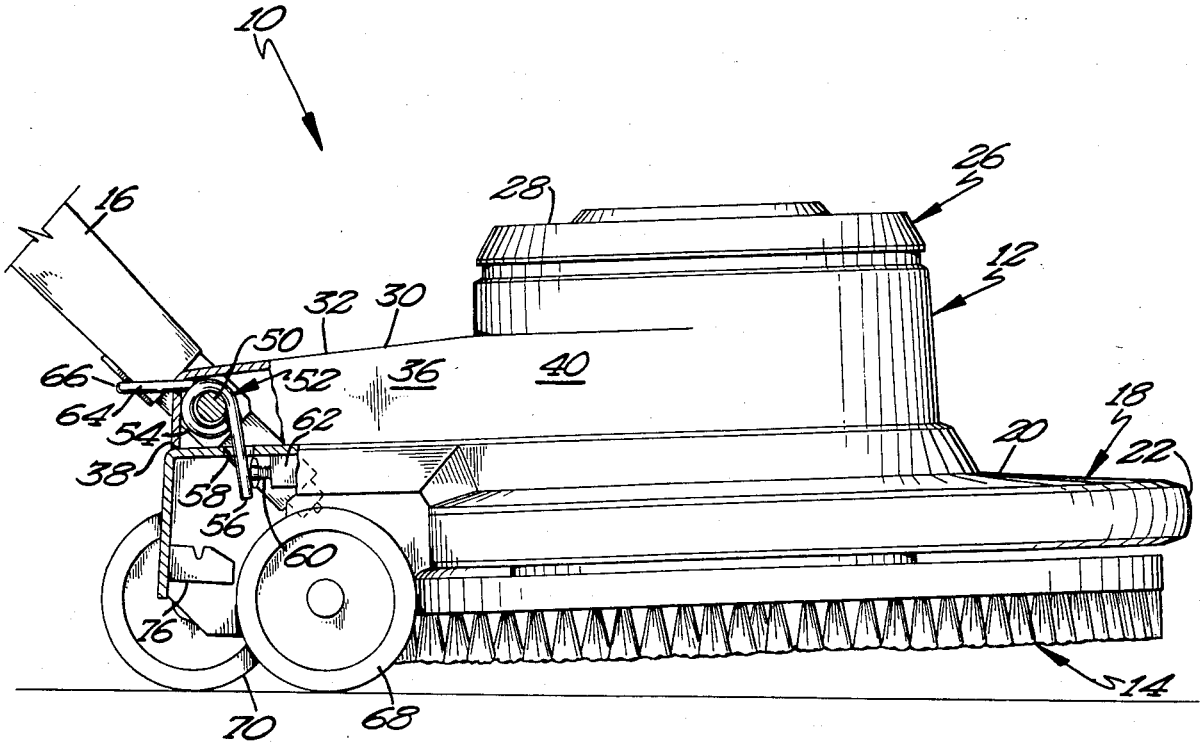
FIG. 3 shows a side view of the floor polishing machine of FIG. 1 with the handle in an operating position and with the polishing member in a non-rotating condition, with portions being broken away to expose internal components.
Figure 4:
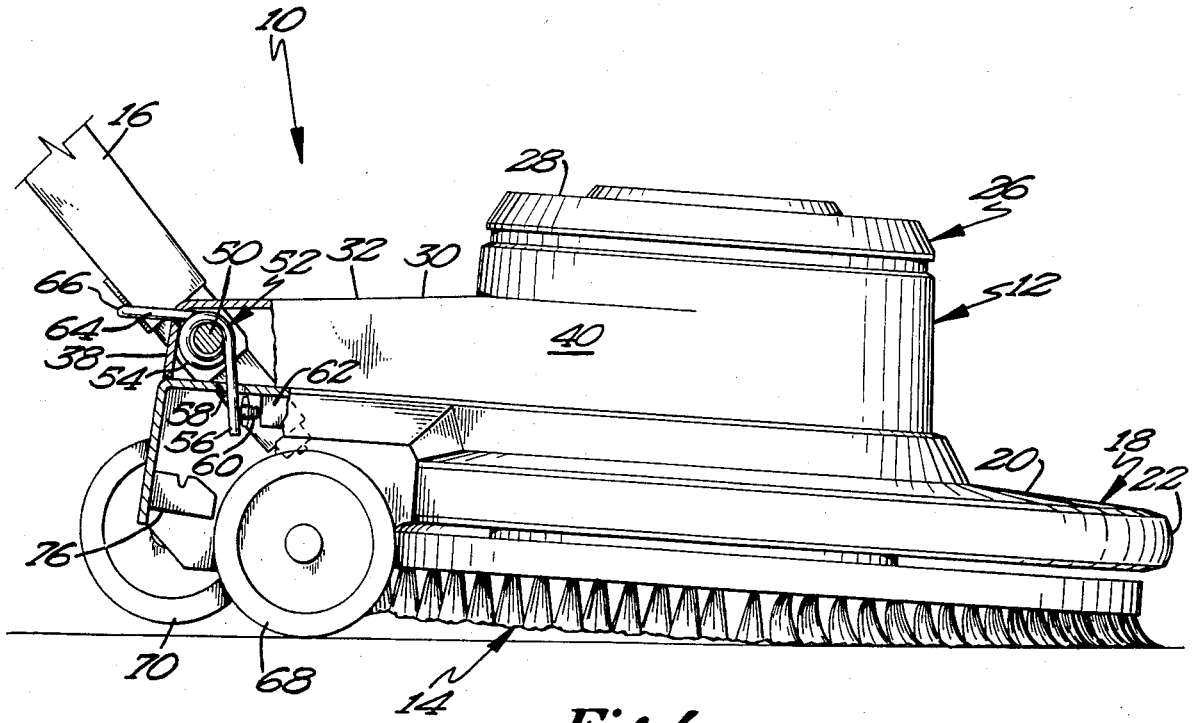
FIG. 4 shows a side view of the floor polishing machine of FIG. 1 with the handle in an operating position and with the polishing member in a rotating condition, with portions being broken away to expose internal components.

After floor polishing machine has been transported to the floor location desired to be polished, plug 78 is reciprocated in handle 16 such that member 80 of plug 78 is removed from member 76 of body portion 12 allowing handle 16 to be pivotal with respect to body portion 12 about pivot pin 50. It can then be appreciated that urging member 52 according to the teachings of the present invention biases handle 16 from an angular position with respect to body portion 12 and towards its upright position with respect to body portion 12. When handle 16 is lowered into its operating position as shown in FIGS. 1, 3, and 4, handle 16 creates a load on torsion springs 54. Since ends 56 of springs 54 are held stationary by their anchoring to platform 20 by abutting with bolts 60 of bosses 62, this load reacts against pivot pin 50 resulting in a downward force to the rear of platform 20. Wheels 68 function as pivot points so that the downward force to the rear of platform 20 effects an upward lift to the front of platform 20. Thus, urging member 52 acts essentially as a coupling device between handle 16 and platform 20 allowing a controlled amount of downward force from handle 16 to be transmitted to platform 20 of housing 18.

It should also be appreciated that without activation of motor 24 rotating polishing member 14 and with handle 16 in an operating position, body portion 12 will pivot about wheels 68 such that the forward portion of body portion 12 and of polishing member 14 is raised above the floor as the result of urging member 52 as best seen in FIG. 3. Specifically, since urging member 52 tends to bias handle 16 in its upright position, when handle 16 is held in its operating position which is out of the upright position, body portion 12 is then biased toward a generally perpendicular relationship with handle 16. It can then be realized that wheels 70 limit movement of body portion 12 by abutting with the floor such that further tilting of body portion 12 about wheels 68 is prevented.

When motor 24 is activated rotating polishing member 14, the high speed of the rotating polishing member 14 forces the air from underneath the center of polishing member 14 causing a partial vacuum under polishing member 14. This partial vacuum creates a suction effect for drawing polishing member 14 to engage the floor surface and urging the forward portion of body portion 12 downward. This movement of the forward portion of body portion 12 downward is further enhanced due to the positioning of motor 24 forward of wheels 68 such that the mass of motor 24 tends to pivot body portion 12 about wheels 68 under the force of gravity towards a level position.

During rotation of polishing member 14, the downward movement of the front platform 20 of body portion created by the suction effect and gravity is countered by the biasing force exerted by urging member 52 which tends to pull the forward end of body portion 12 upward. Furthermore, it can be appreciated that the front is urged upwardly by member 52 with substantially equal force regardless of the position of handle 16 due to the constant spring force exerted by torsion springs 54. Likewise, the downward movement force created by the suction effect and gravity is substantially constant for the same rotation speeds of polishing member 14. Therefore, it can be appreciated that a calculated balance can be created between the force of handle 16 to lift polishing member 14 through urging member 52 and the characteristic of polishing member 14 to pull itself down due to the suction effect created. Therefore, pressure placed on the floor surface by polishing member 14 is substantially constant regardless of the pivotal position of handle 16 with respect to platform 20 of housing 12. Thus, even though the pivotal position of handle 16 with respect to platform 12 should change by the unevenness of the floor surface or by holding the end of handle 16 at varying heights above the floor surface, the pressure polishing member 14 places upon the floor surface is controlled automatically and without being dependent on operator involvement.

It can then be appreciated that wheels 70 in the preferred form of floor polishing machine 10 according to the teachings of the present invention perform a dual function. First, they limit the amount of upward movement of the front of polishing member 14 under the bias of urging member 52 to insure that a partial vacuum is created when polishing member 14 is initially rotated to create the suction effect for pulling the front of polishing member 14 downward. Secondly, wheels 70 according to the teachings of the present invention serve as transport wheels when floor polishing machine 10 is being moved between locations.

It should then be appreciated that urging member 52 in its most preferred form of torsion springs 54 is particularly advantageous. Specifically, torsion springs 54 provide a fairly constant spring force at all times. Thus, torsion springs 54 pull the forward end of platform 22 upward with substantially equal force regardless of the position of handle 16 and without variable force compensation such as by complicated lever arm connections. Thus, the construction of floor polishing machine 10 according to the teachings of the present invention utilizing torsion springs is advantageous.

Now that the basic teachings of the present invention have been explained, many extensions and variations will be obvious to one having ordinary skill in the art. For example, body portion 12 may take other forms and constructions while utilizing the teachings of the present invention than the preferred form and construction as shown and described. As an example, housings 18 and 26 and the mounting of wheels 68 and 70 can have other shapes, forms, and constructions while obtaining the advantages of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Machine for polishing floor surfaces comprising, in combination: a body portion adapted to be moved along the floor, with the body portion including a platform having a front and a rear; a polishing member mounted for rotation about a polishing axis within the body portion for polishing the floor surface when the body portion is moved along the floor; a handle for guiding and controlling the movement of the body portion along the floor, with the handle being pivotally mounted to the platform about a pivot axis for movement between operating positions and a transport position; a first set of wheels rotatably mounted adjacent the rear of the platform and between the handle pivot axis and the polishing axis for supporting the platform above the floor surface; torsion spring means between the handle and the platform for urging the platform to pivot about the first set of wheels when the handle is in an operating position such that the rear of the platform moves downwardly and the front of the platform moves upwardly; and a second set of wheels located at the rear of the platform and on the opposite side of the first set of wheels than the polishing axis, with the level of the second set of wheels being higher than the first set of wheels for limiting the amount of upward movement of the front of the platform by the torsion springs when the polishing member is not being rotated in the body portion allowing a partial vacuum to be formed under the polishing member when the polishing member is initially rotated in the body portion to place a downward suction on the polishing member and counteracting with the torsion springs to place an even polishing force on the floor surface by the polishing member regardless of the pivotal position of the handle with respect to the platform and regardless of the unevenness of the floor surface.

2. The floor polishing machine of claim 1 wherein the pivot axis of the handle is intermediate the first and second set of wheels.

3. The floor polishing machine of claim 2 wherein said torsion spring means includes first and second torsion springs, with the torsion springs having first ends and second ends; and wherein the floor polishing machine further comprises, in combination: means for anchoring the first ends of the torsion springs to the platform; and means for connecting the second ends of the torsion springs to the handle, with the torsion springs being located concentrically about the pivot axis of the handle and on opposite sides of the handle.

4. The floor polishing machine of claim 3 wherein the anchoring means comprises, in combination: a boss secured to the platform adjacent each of said first ends; and a bolt threadably received in each of the bosses, with each of the first ends of the torsion springs abutting with said bolts.

5. The floor polishing machine of claim 3 wherein the connecting means comprises a connection member interconnected between the second ends of the first and second torsion springs, with the connection member abutting with the handle above the pivot axis of the handle.

6. The floor polishing machine of claim 1 wherein the handle has an end; and wherein the floor polishing machine further comprises, in combination: means for locking the handle in its transport position comprising, in combination: a plug reciprocally received in the end of the handle; and a catch secured to the platform and complementary to the plug for removably attaching the plug to the catch.

7. Machine for polishing floor surfaces comprising, in combination: a platform having a front and a rear; a first set of wheels rotatably mounted along a generally horizontal wheel axis adjacent the rear of the platform for supporting the platform above the floor surface; a polishing member rotatably mounted to the platform for rotation about a generally vertical axis and means for rotating the polishing member about the vertical axis; a handle pivotally mounted to the platform about a generally horizontal pivot axis located on the opposite side of the wheel axis than the vertical axis of the polishing member; means for coupling the handle and the platform for pivoting the platform about the wheel axis of the first set of wheels with the rear of the platform being biased in a downward direction and the front of the platform being biased in an upward direction; and means located at the rear of the platform and on the opposite side of the wheel axis than the vertical axis of the polishing member for limiting the amount of upward movement of the front of the platform by the coupling means when the polishing member is not being rotated by the rotating means allowing a partial vacuum to be formed under the polishing member when the polishing member is initially rotated by the rotating means to place a downward suction on the polishing member and counteracting with the coupling means to place an even force on the floor surface by the polishing member regardless of the pivotal position of the handle with respect to the platform and regardless of the unevenness of the floor surface.

8. The floor polishing machine of claim 7 wherein the first set of wheels space the rear of the polishing member from the floor surface.

9. The floor polishing machine of claim 8 wherein the first set of wheels space the rear of the polishing member from the floor surface such that the front two-thirds of the polishing member engage the floor surface when the polishing member is rotated by the rotating means.

10. The floor polishing machine of claim 8 wherein the first set of wheels space the entire polishing member from the floor surface when the polishing member is not being rotated by the rotating means.

11. The floor polishing machine of claim 7 wherein the handle is pivotally mounted to the platform between operating positions and a transport position; and wherein the limiting means also enables the transport of the platform and polishing member over the floor surface when the handle is in the transport position.

12. The floor polishing machine of claim 11 wherein the limiting means comprises a second set of wheels extending at a level slightly above the level of the first set of wheels.

13. The floor polishing machine of claim 12 wherein the level of the second set of wheels is in the range of $\frac{1}{8}$ to $\frac{1}{4}$ inches above the level of the first set of wheels.

14. The floor polishing machine of claim 11 wherein the handle has an end; and wherein the floor polishing machine further comprises, in combination: means for locking the handle in its transport position comprising, in combination: a plug reciprocally received in the end of the handle; and a catch secured to the platform and complementary to the plug for removably attaching the plug to the catch.

15. The floor polishing machine of claim 7 wherein the coupling means comprises, in combination: means for urging the front of the platform towards the handle.

16. The floor polishing machine of claim 15 wherein the urging means comprises at least a first torsion spring.

17. The floor polishing machine of claim 15 wherein the urging means comprises, in combination: first and second torsion springs having first ends and second ends, with the torsion springs being located concentrically about the pivot axis of the handle and on opposite sides of the handle; means for anchoring the first ends of the torsion springs to the platform; and means for connecting the second ends of the torsion springs to the handle.

18. The floor polishing machine of claim 17 wherein the anchoring means comprises, in combination: a boss secured to the platform adjacent each of said first ends; and a bolt threadably received in each of the bosses, with each of the first ends of the torsion springs abutting with said bolts.

19. The floor polishing machine of claim 17 wherein the connecting means comprises a connection member interconnected between the second ends of the first and second torsion springs, with the connection member abutting with the handle above the pivot axis of the handle.

20. The floor polishing machine of claim 7 wherein the pivot axis of the handle is intermediate the wheel axis of the first set of wheels and the limiting means.

* * * * *